United States Patent [19]

Ikegami et al.

[11] Patent Number: 4,751,470

[45] Date of Patent: Jun. 14, 1988

[54] CHARGED PARTICLE ACCELERATING APPARATUS

[75] Inventors: Kazunori Ikegami; Shiro Nakamura; Tadatoshi Yamada; Shunji Yamamoto; Tetsuya Matsuda; Tokio Fukunaga, all of Amagasaki, Japan

[73] Assignee: Mitsubishi Denki Kabushiki Kaisha, Tokyo, Japan

[21] Appl. No.: 13,431

[22] Filed: Feb. 11, 1987

[30] Foreign Application Priority Data

| | | | |
|---|---|---|---|
| Feb. 12, 1986 | [JP] | Japan | 61-28448 |
| Feb. 27, 1986 | [JP] | Japan | 61-43835 |
| Sep. 27, 1986 | [JP] | Japan | 61-228855 |
| Sep. 27, 1986 | [JP] | Japan | 61-228854 |

[51] Int. Cl.[4] ..... H05H 13/04; H05H 7/00

[52] U.S. Cl. ..... 328/233; 328/235

[58] Field of Search ..... 328/235, 236, 233

[56] References Cited

PUBLICATIONS

J. Vac. Sci. Technol. A2(2), Apr.-Jun. 1984, S. 1170-1175.

IEEE Transactions Nuclear Science, vol. NS-26, No. 3, 1979, S. 3803-3805 and 3806-3808.

Design of UVSOR storage ring published in Dec. 1982 by Bunshi Kagaku Kenkyusho.

SOR-RING: An Electron Storage Ring Dedicated to Spectroscopy, by T. Miyahara et al., *Particle Accelerators,* vol. 7, No. 3, pp. 163-175, 1976.

*Primary Examiner*—Palmer C. DeMeo

*Attorney, Agent, or Firm*—Oblon, Fisher, Spivak, McClelland & Maier

[57] ABSTRACT

A charged particle accelerating apparatus has a vacuum chamber for transporting, accelerating, deflecting or storing charged particles. A layer of a low gas-generating material is placed in the vacuum chamber at a position where radiation generated by deflection of the charged particles are irradiated, the low gas-generating material having properties of generating an amount of gas less than a material constituting the vacuum chamber.

11 Claims, 5 Drawing Sheets

CHARGED PARTICLE ACCELERATING APPARATUS

BACKGROUND OF THE INVENTION

1. Field of the Invention

The present invention relates to a charged particle accelerating apparatus. More particularly, it relates to a charged particle accelerating apparatus for accelerating or storaging beams of charged particles such as electron beams so that radiation beams are generated from deflection parts of the apparatus.

2. Discussion of Background

FIG. 8 shows a conventional charged particle accelerating apparatus. In FIG. 8, a reference numeral 1 designates a storage ring for storing charged particles, a numeral 2 designates a beam line for introducing the charged particles into storage ring 1, numerals 3 designate deflecting electromagnets for forming a balanced circular orbit 4 by deflecting the charged particles, numerals 5 designate synchrotron orbital radiations (SOR) produced when the charged particles are deflected, the radiations being emitted outside to utilize them for, for instance, lithography, numerals 6 designate four-pole electromagnets for converging the charged particles, numerals 7 designate six-pole electromagnets for correcting a non-linear magnetic field of the deflecting electromagnets 3 or correcting chromaticity, a numeral 8 designates a high frequency cavity which compensates energy loss of the charged particles resulted from emission of the radiations, and accelerates the charged particles to have a given level of energy, a numeral 9 designates a kicker which shifts the balanced orbit 4 of the charged particles so that the particles can be easily injected in the storage ring 1, a numeral 10 designates a vacuum doughnut (or a vacuum chamber) for providing a path of the charged particles, a numeral 11 designates an inflector for permitting injection of the charged particles into the storage ring 1 from the beam line 2 and numeral 12 designates vacuum pumps for maintaining the vacuum doughnut to be in a highly vacuum condition.

The operation of the conventional apparatus will be described. The charged particles injected from the injecting beam line 2 into the storage ring 1 are deflected in the inflector 11 in a pulsating manner. The particles are circulated on an orbit slightly deflected from the balanced orbit 4 by the kicker 9, and after being circulated several times, they continue to circulate on the balanced orbit 4 (the balanced orbit is determined by the arrangement of the deflecting electromagnets 3 and the four-pole electromagnets 6). In the circulation of the charged particles, the high frequency cavity 8 accelerates the particles and the six-pole electromagnets 7 corrects unevenness of the magnetic fields in the radial directions of the deflecting electromagnets 3 or corrects the chromaticity. When the charged particles circulating along the balanced orbit 4 are deflected in the magnetic fields formed by the deflecting electromagnets 3, there take place electromagnetic radiations in the direction tangential to the orbit, the radiation being caused by Bremsstrahalung. The electromagnetic radiations are generated as radiation beams.

Generally, there are a number of radiation beam lines 5 and they increase efficiency in the discharged particle accelerating apparatus. In FIG. 8, a single radiation beam line 5 is shown for each of the deflecting electromagnets 3.

The vacuum chamber 10 is made of stainless steel having a high mechanical strength and facilitating baking. The interior of the vacuum chamber 10 is kept at a highly vacuumed condition by means of the vacuum pump 12 so that a shortened life of the charged particles due to energy loss by the collision of the particles to the molecules of a gas can be prevented. However, in the vacuum chamber of stainless steel surrounded by the deflecting electromagnet 3, a large amount of gas is generated from the stainless steel, whereby the vacuumed condition in the apparatus becomes poor. Thus, the gas generated in the vacuum chamber shortens the life of the charged particles.

There has been proposed a vaccum chamber made of an aluminum alloy. However, although the aluminum alloy vacuum chamber controls generation of gas by the synchrotoron radiation beams, it is impossible to carry out the baking at a high temperature because it has a low mechanical strength.

There has been used a vacuum chamber in a conventional electron storage ring as shown in FIG. 9. In FIG. 9, the same reference numerals as in FIG. 8 designate the same or corresponding parts. In the vacuum chamber made of stainless steel, SOR beams 5 are emitted from the balanced orbit 4. A numeral 24 designates a heat generating portion in the vacuum chamber, which is caused by radiation of the SOR beams.

In the apparatus as shown in FIG. 9, when the charged particles (electrons) are moved along the curved orbit by the deflectihg electromagnets 3, the SOR beams 5 are emitted in the direction tangential to the curved orbit. The intensity of the beams are very strong and have an extremely small diameter (less than 1 mm). Accordingly, when the beams strike the inner wall of the vacuum chamber 10 made of stainless steel, the surface of the inner wall is locally heated because thermal conductivity of the material is poor. Accordingly, as shown in FIG. 10, a thermal expansion takes plase in the inner wall portion of the vacuum chamber 10 in the direction indicated by an arrow mark 26. However, no thermal expansion takes place in the portion exposed in the atmosphere. Namely, only the portion facing the inside of the vacuum chamber expands. When deformed, the vacuum chamber 10 tends to form a recessed portion in the direction indicated by an arrow mark 27 to release the stress due to the expansion. However, it is difficult to form the recessed portion in the arrow mark direction 27 because the vacuum chamber has corner portions 28 in a form of an L (angle) shape. In such L-shape structure, it is difficult to cause the deformation of the corner portion inwardly. Accordingly, it is impossible to solely cause the deformation of that portion in the arrow mark direction 27. Namely, the vacuum chamber 10 is deformed to such extend that a force in the arrow mark direction 17 which is caused by the thermal expansion is balanced by a reactive force which is determined by the strength of the corner portion 8 and a material used for the vacuum chamber. Namely, the depth in the recessed portion is relatively small. Accordingly, the thermal expansion in the arrow mark direction 27 is more and less hindered and a large compression force is generated at the part of thermal expansion, i.e. the heat generating part 24. Further, the expanding part is heated at a high temperature (about 500° C.) for a long time by the SOR beams, whereby there arises a problem of creaping. In addition, there is a problem of fatigue of the material because of a repeated stress. Further, there is a problem of production of the gas in the case that the vacuum chamber is made of stainless steel as described above.

SUMMARY OF THE INVENTION

It is an object of the present invention to provide a charged particle accelerating apparatus which prolongs the life of charged particles.

The foregoing and the other objects of the present invention have been attained by providing a charged particle accelerating apparatus having a vacuum chamber for transporting, accelerating, deflecting or storaging charged particles, characterized in that a layer of a low gas-generating material is placed in said vacuum chamber at a position where radiation beams generated by deflection of the charged particles are irradiated, said low gas-generating material having properties of generating an amount of gas less than a material constituting said vacuum chamber.

BRIEF DESCRIPTION OF THE DRAWINGS

More complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Preferred embodiments of the present invention will be described with reference to the drawings.

Figure 1:
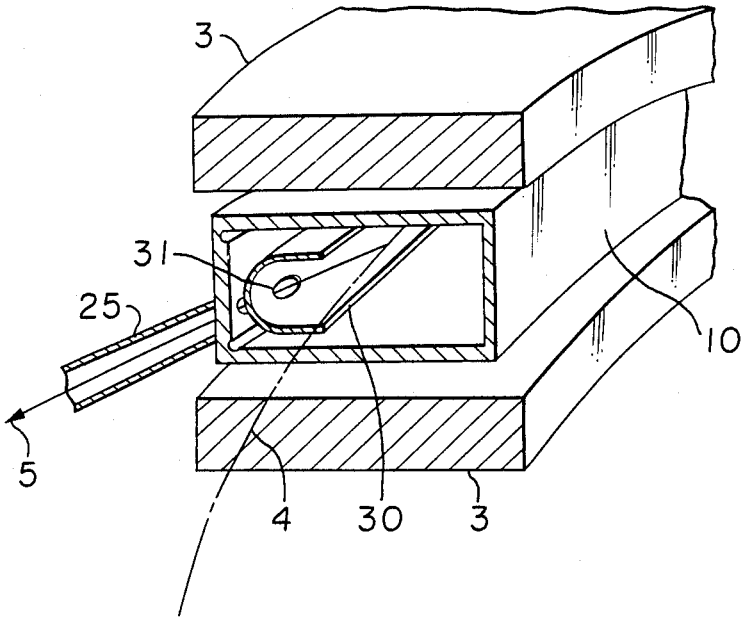
FIG. 1 is an enlarged perspective view partly cross-sectioned and broken of an embodiment of the charged particle accelerating apparatus according to the present invention.

FIG. 1 shows a carved portion in cross section of a vacuum chamber 10 of an embodiment of the charged particle accelerating apparatus according to the present invention. A plate having a U-shape in cross section is placed in the vacuum chamber 10 along its longitudinal direction. The plate 30 is made of an aluminum alloy. A plurality of apertures 31 are formed in the bottom of the U-shaped plate 30 in the longitudinal direction to allow radiation beams to pass therethrough.

Figure 2:
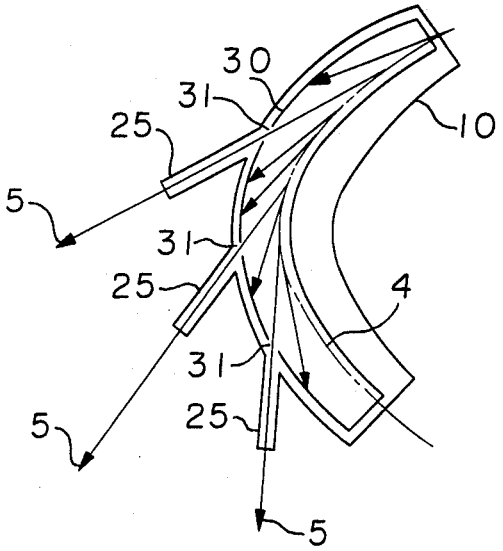
FIG. 2 is a diagram showing a vacuum chamber shown in FIG. 1.

FIG. 2 is a longitudinal cross-sectional view of a part of the curved portion of the vacuum chamber 10.

In FIG. 2, a part of the radiation beams 5 strike the aluminum alloy plate 30 where they are attenuated by absorption.

An amount of a gas generated by the irradiation of radiation beams can be expressed by the following equation.

$$QSR = 1.45 \times 10^{-2}\,\gamma \cdot I_b \cdot D\left\{1 - \left(\frac{\epsilon_0}{\epsilon_c}\right)^{1/3}\right\}$$

[torr · l/s]

Where, $$Y = \frac{E}{m_0 C^2},$$

E is the energy of the beams of the charged particles, $m_0$ is the mass of the charged particles in a static state, C is the light velocity, $I_b$ is the current of the charged particle beams, $\epsilon_0$ is the work function of a wall surface on which radiation beams are irradiated, and $\epsilon_c$ is the critical energy and D is the quantity of molecules of a gas (mol/$e^-$) emitted by photoelectrons having an energy greater than $\epsilon_0$. The value of D in the above-mentioned equation varies depending on the material of the wall surface of the vacuum chamber. In comparing the stainless steel with the aluminum alloy, the value in gas generation of the stainless steel is about 2.5 times as large as the aluminum alloy. Namely, when the aluminum alloy is used for the wall surface of the vacuum chamber, an amount of the gas generated by the radiation beams can be reduced to about 40% in comparison with the stainless steel.

As shown in FIG. 2, a large number of radiation beams 5 are generated in the tangential direction with respect to the balanced orbit 4 of the charged particles. Of the radiation beams 5, the beams passing through the apertures 31 and the radiation beam lines 25 are effectively utilized. However, the other radiation beams striking the inner wall of the vacuum chamber are useless. As is clear from FIG. 2, a large quantity of radiation beams function to produce the gas. The plate 30 of the aluminum alloy is to interrupt the substantially completely useless radiation beams.

It is an important point that the aluminum alloy plate 30 does not function as the vacuum chamber of the apparatus. Since the mechanical strength of the aluminum alloy is weaker than the stainless steel, it may easily cause breaking of the vacuumed condition. Further, it is not durable to a high temperature caused by the baking. In the embodiment of the present invention, however, the vacuum chamber itself is made of the stainless steel and therefore, it is reliable as a container to keep a vacuum condition.

Although the above-mentioned embodiment uses the U-shaped aluminum alloy plate 30, a flat-shaped aluminum alloy plate 30 may be used. A pipe of an aluminum alloy may be used. The aluminum alloy plate 30 may be attached at a desired position as far as it reduces an amount of the gas generated by the radiation beams.

Figure 3:
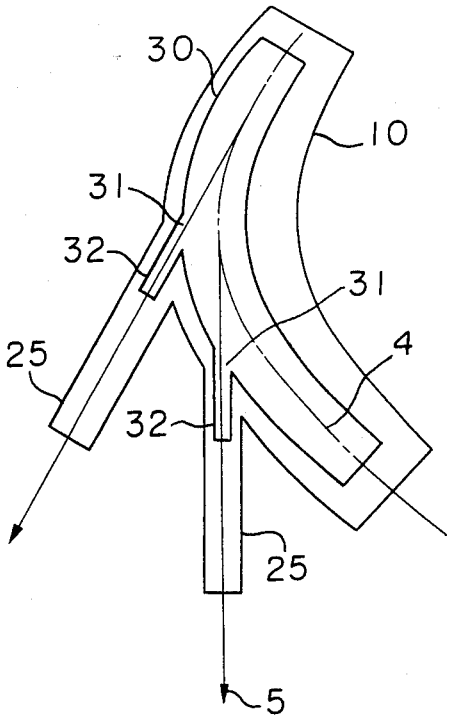
FIG. 3 is an enlarged cross-sectional view of the vacuum chamber according to the present invention.

FIG. 3 shows another embodiment of the vacuum chamber of the present invention. In this embodiment, a guide member 32 is connected to each of the apertures 31 formed in the U-shaped aluminum alloy plate 30. Accordingly, of the radiation beams passing through the apertures 31, the beams which are not in parallel to the radiation beam lines 25 strike the wall of the guide member and are attenuated thereby. Thus, the gas which may be produced by the contact of the radiation beams with the stainless steel can be reduced.

Figure 4:
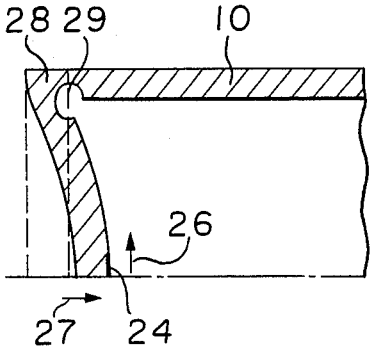
FIG. 4 is another embodiment of the vacuum chamber of the present invention.

FIG. 4 is a cross-sectional view partly broken of the vacuum chamber 10.

In FIG. 4 showing an embodiment of the vacuum chamber 10 in cross section, a recess 29 is provided at the corner portion 28 of the vacuum chamber. The recess 29 extends along the curved vacuum chamber. The other recess 29 is also provided in the corner at the symmetrical position with respect to the longer center axis of it. With the provision of the recess 29, deformation of the wall of the vacuum chamber 10 heated by the radiation beams easily occurs in the direction of the arrow mark 27, whereby the wall of the vacuum chamber 10 is deformed only in the arrow mark direction 27 by the thermal expansion. Namely, a thermal stress by compression in the heated wall portion can be reduced.

Figure 5:
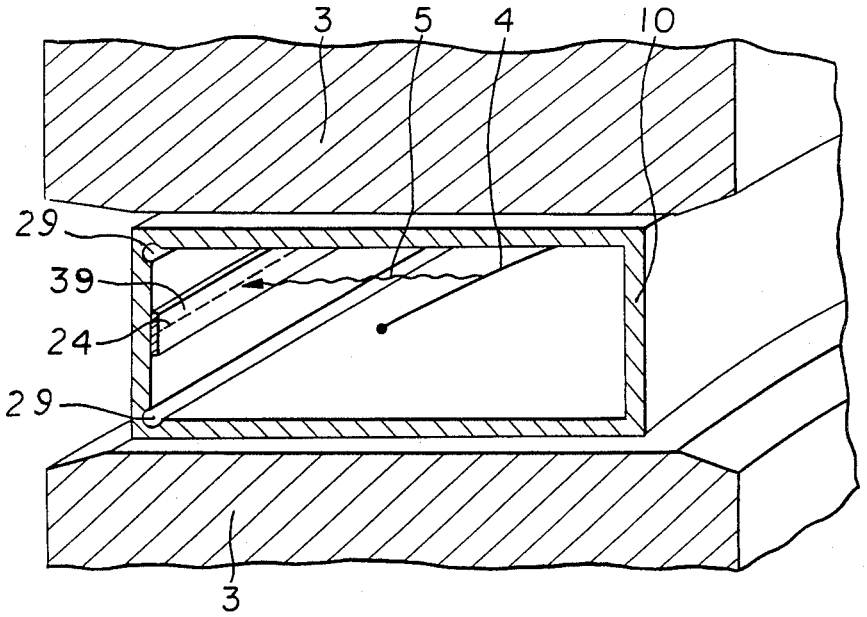
FIG. 5 is still another embodiment of vacuum chamber of the present invention.

Another embodiment of the vacuum chamber of the present invention will be described with reference to FIG. 5. In the embodiment, an elongated plate 39 made of an aluminum alloy such as duralumin is placed on the inner wall portion of the vacuum chamber where the radiation beams emitted from he balanced orbit strike. As described above, that portion is heated by the SOR beams. However, in this embodiment, since the locally heated portion is covered by the elongated plate of the aluminum alloy having a good thermal conductivity, the thermal stress can be sufficiently reduced in comparision with the vacuum chamber made of stainless steel.

An amount of the gas generated from the vacuum chamber made of aluminum alloy is about 40% as much as that of the stainless steel. Accordingly, even by irradiation of the SOR beams, the vacuum chamber of the aluminum alloy can be maintain to have a desired pressure range.

Figure 6:
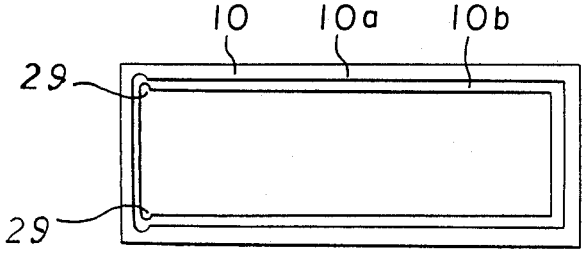
FIG. 6 is a cross-sectional view of a separate embodiment of the vacuum chamber of the present invention.

FIG. 6 shows another embodiment of the vacuum chamber 10. In this embodiment, an aluminum alloy **10*b* is formed on the vacuum chamber wall (made of stainless steel) 10*a* of the vacuum chamber 10** by means of plating, melt-injecting, explosion-bonding and so on to form a two-layered wall construction. The plating method may be used to form relatively thin coating layer on the base material; the melt-injecting method may be used to form a relatively thin coating layer; and the explosion-bonding method may be used to form a clad having substantially the same thickness as the thickness of the base material.

Thus, the two-layered wall construction having the inner aluminum alloy layer reduces the production of gas to the extend of about 40% in comparison with the vacuum chamber having the inner wall of stainless steel. Accordingly, a rate of discharging of gas to obtain the same performance in vacuum can be small, hence the manufacturing cost for the apparatus becomes low. When the vacuum chamber having an aluminum alloy layer is used for an electron storage ring, the life of the ring is prolonged, whereby the production of semiconductor devices by a lithography method can be successively carried out for a long period of time. This contributes to a reduction in the manufacturing cost of the semiconductor devices.

Figure 7:
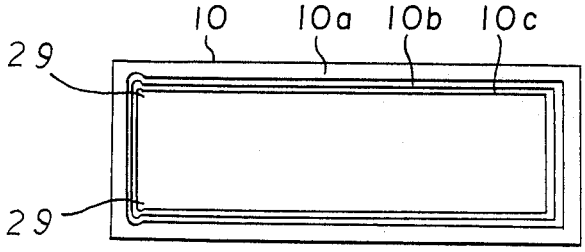
FIG. 7 shows another embodiment similar to that in FIG. 6.
Figure 8:
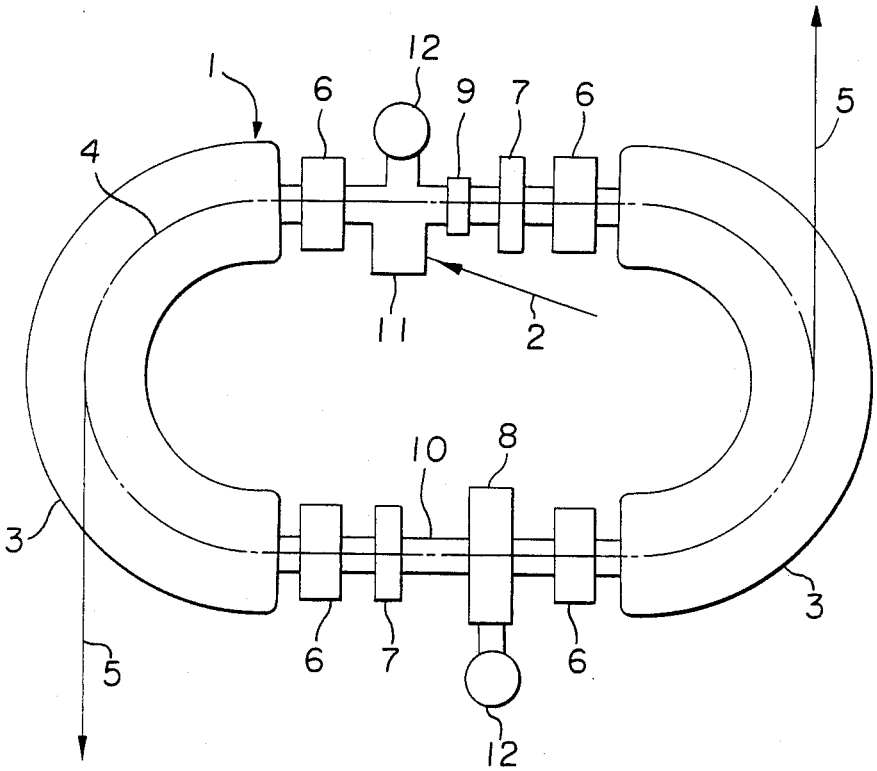
FIGURE 8 PRIOR ART
FIG. 8 is a diagram showing a conventional charged particle accelerating apparatus.
Figure 9:
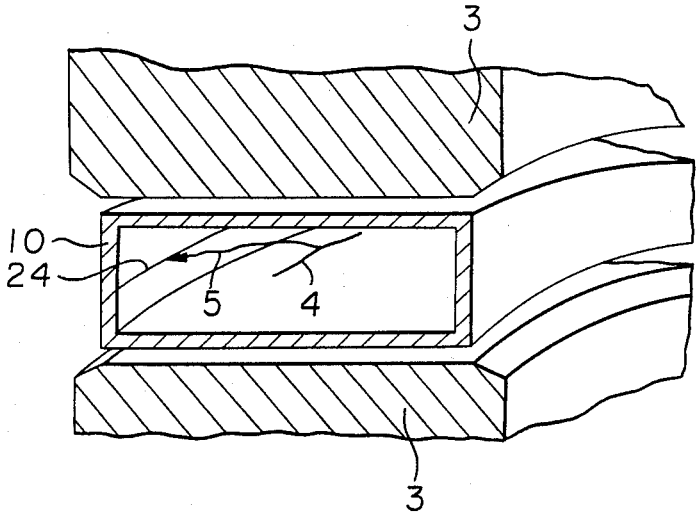
FIGURE 9 PRIOR ART
FIG. 9 is an enlarged perspective view partly broken of the conventional vacuum chamber used for the conventional charged particle accelerating apparatus.
Figure 10:
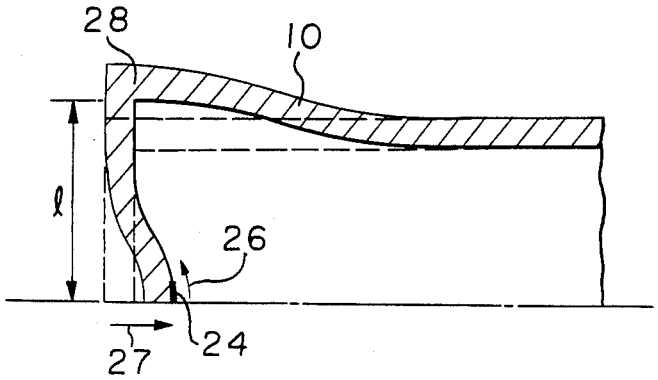
FIGURE 10 PRIOR ART
FIG. 10 is a diagram for explaining a recess produced in a wall surface in the conventional vacuum chamber.

FIG. 7 shows still another embodiment of the vacuum chamber. In this embodiment, the vacuum chamber has a three layered wall structure, i.e. the base material **10*a*, the intermediate layer and the innermost layer 10*c*** made of an aluminum alloy. Of course, more than three layers may be formed on the inner wall of the vacuum chamber.

As aluminum alloys preferrably used in the present invention, there are 3003, 3203, 3004, 3005, 5005, 5052, 5652, 5154, 5254, 5454, 5083, 5086, 5N01, 1080, 1070, 1050, 1100, 1200 and 1N00 (Japanese Industrial Standard). The detail of the aluminum alloys is shown in a table which is described below.

Aluminum having a high purity is also applicable to the present invention to reduce the generation of the gas.

TABLE

| | composition (wt %) | | | | | | | | | | | |
|---|---|---|---|---|---|---|---|---|---|---|---|---|
| | | | | | | | | | | others | | |
| | Si | Fe | Cu | Mn | Mg | Cr | Zn | Zr + Ti.V.Zr | Tl | each | total | Al |
| 1080 | 0.15 or less | 0.15 or less | 0.03 or less | 0.02 or less | 0.02 or less | — | 0.03 or less | — | 0.03 or less | 0.02 or less | — | 99.80 or more |
| 1070 | 0.20 or less | 0.25 or less | 0.04 or less | 0.03 or less | 0.03 or less | — | 0.04 or less | — | 0.03 or less | 0.03 or less | — | 99.70 or more |
| 1050 | 0.25 or less | 0.40 or less | 0.05 or less | 0.05 or less | 0.05 or less | — | 0.05 or less | — | 0.03 or less | 0.03 or less | — | 99.50 or more |
| 1100 | Si + Fe 1.0 or less | | 0.05–0.20 | 0.05 or less | — | — | 0.10 or less | — | — | 0.05 or less | 0.15 or less | 99.00 or more |
| 1200 | Si + Fe 1.0 or less | | 0.05 or less | 0.05 or less | — | — | 0.10 or less | — | 0.05 or less | 0.05 or less | 0.15 or less | 99.00 or more |
| 1N00 | Si + Fe 1.0 or less | | 0.05–0.20 | 0.05 or less | 0.10 or less | — | 0.10 or less | — | 0.10 or less | 0.05 or less | 0.15 or less | 99.00 or more |
| 2014 | 0.50–1.2 | 0.7 or less | 3.9–5.0 | 0.40–1.2 | 0.20–0.8 | 0.10 or less | 0.25 or less | Zr + Ti 0.20 or less | 0.15 or less | 0.05 or less | 0.15 or less | rest |
| 2014 (A) | 0.50–1.2 | 0.7 or less | 3.9–5.0 | 0.40–1.2 | 0.20–0.8 | 0.10 or less | 0.25 or less | Zr + Ti 0.20 or less | 0.15 or less | 0.05 or less | 0.15 or less | rest |
| 2014 (B) | 0.35–1.0 | 0.6 or less | 0.10 or less | 0.8 or less | 0.8–1.5 | 0.35 or less | 0.20 or less | — | 0.10 or less | 0.05 or less | 0.15 or less | rest |
| 2017 | 0.20–0.8 | 0.7 or less | 3.5–4.5 | 0.40–1.0 | 0.40–0.8 | 0.10 or less | 0.25 or less | Zr + Ti 0.20 or less | 0.15 or less | 0.05 or less | 0.15 or less | rest |
| 2024 | 0.50 or less | 0.50 or less | 3.8–4.9 | 0.30–0.9 | 1.2–1.8 | 0.10 or less | 0.25 or less | Zr + Ti 0.20 or less | 0.15 or less | 0.05 or less | 0.15 or less | rest |
| 2024 (A) | 0.50 or less | 0.50 or less | 3.8–4.9 | 0.30–0.9 | 1.2–1.8 | 0.10 or less | 0.25 or less | Zr + Ti 0.20 or less | 0.15 or less | 0.05 or less | 0.15 or less | rest |
| 2024 (B) | Si + Fe 0.7 or less | | 0.10 or less | 0.05 or less | 0.05 or less | — | 0.10 or less | — | 0.03 or less | 0.03 or less | — | 99.30 or more |
| 3003 | 0.6 or less | 0.7 or less | 0.05–0.20 | 1.0–1.5 | — | — | 0.10 or less | — | — | 0.05 or less | 0.15 or less | rest |

TABLE-continued

| | composition (wt %) | | | | | | | | | | | |
|---|---|---|---|---|---|---|---|---|---|---|---|---|
| | | | | | | | | | | others | | |
| | Si | Fe | Cu | Mn | Mg | Cr | Zn | Zr + Ti.V.Zr | Tl | each | total | Al |
| 3203 | 0.6 or less | 0.7 or less | 0.05 or less | 1.0–1.5 | — | — | 0.10 or less | — | — | 0.05 or less | 0.15 or less | rest |
| 3004 | 0.30 or less | 0.70 or less | 0.25 or less | 1.0–1.5 | 0.8–1.3 | — | 0.25 or less | — | — | 0.05 or less | 0.15 or less | rest |
| 3005 | 0.6 or less | 0.7 or less | 0.30 or less | 1.0–1.5 | 0.20–0.6 | 0.10 or less | 0.25 or less | — | 0.10 or less | 0.05 or less | 0.15 or less | rest |
| 5005 | 0.30 or less | 0.7 or less | 0.20 or less | 0.20 or less | 0.50–1.1 | 0.10 or less | 0.25 or less | — | — | 0.05 or less | 0.15 or less | rest |
| 5052 | 0.25 or less | 0.40 or less | 0.10 or less | 0.10 or less | 2.2–2.8 | 0.15–0.35 | 0.10 or less | — | — | 0.05 or less | 0.15 or less | rest |
| 5652 | Si + Fe 0.40 or less | | 0.04 or less | 0.01 or less | 2.2–2.8 | 0.15–0.35 | 0.10 or less | — | — | 0.05 or less | 0.15 or less | rest |
| 5154 | Si + Fe 0.45 or less | | 0.10 or less | 0.10 or less | 3.1–3.9 | 0.15–0.35 | 0.20 or less | — | 0.20 or less | 0.05 or less | 0.15 or less | rest |
| 5254 | Si + Fe 0.45 or less | | 0.05 or less | 0.01 or less | 3.1–3.9 | 0.15–0.35 | 0.20 or less | — | 0.05 or less | 0.05 or less | 0.15 or less | rest |
| 5454 | 0.25 or less | 0.40 or less | 0.10 or less | 0.50–1.0 | 2.4–3.0 | 0.05–0.20 | 0.25 or less | — | 0.20 or less | 0.05 or less | 0.15 or less | rest |
| 5083 | 0.40 or less | 0.40 or less | 0.10 or less | 0.40–1.0 | 4.0–4.9 | 0.05–0.25 | 0.25 or less | — | 0.15 or less | 0.05 or less | 0.15 or less | rest |
| 5086 | 0.40 or less | 0.50 or less | 0.10 or less | 0.20–0.7 | 3.5–4.5 | 0.05–0.25 | 0.25 or less | — | 0.15 or less | 0.05 or less | 0.15 or less | rest |
| 5N01 | 0.15 or less | 0.25 or less | 0.20 or less | 0.20 or less | 0.20–0.6 | — | 0.03 or less | — | — | 0.05 or less | 0.10 or less | rest |

(A): core material
(B): surface material

In the above-mentioned embodiment, the vacuum chamber is used for an electron storage ring apparatus. However, the same function is obtainable when it is used for another charged particle accelerating apparatus such as a synchrotron accelerator.

Obviously, many modifications and variations of the present invention are possible in the light of the above teachings. It is therefore to be understood that within the scope of the appended claims, the invention may be practiced otherwise than as specifically described.

What is claimed is:

1. A charged particle accelerating apparatus having a vacuum chamber for transporting, accelerating, deflecting or storing charged particles, characterized in that a layer of a low gas-generating material is placed in said vacuum chamber at a position where radiation beams generated by deflection of the charged particles are irradiated, said low gas-generating material having properties of generating an amount of gas less than a material constituting said vacuum chamber.

2. The charged particle accelerating apparatus according to claim 1, wherein said layer is a body separated from said vacuum chamber and has no function to maintain a vacuumed condition.

3. The charged particle accelerating apparatus according to claim 1, wherein said layer is made of an aluminum alloy.

4. The charged particle accelerating apparatus according to claim 1, wherein said material for the layer has a thermal conductivity higher than that of a material constituting an inner wall of said vacuum chamber.

5. The charged particle accelerating apparatus according to claim 4, wherein said layer is firmly attached to the inner surface of said vacuum chamber.

6. The charged particle accelerating apparatus according to claim 1, wherein said vacuum chamber is of a ring form and said layer is provided at the outer circumferential portion in said ringed vacuum chamber.

7. The charged particle accelerator apparatus according to claim 6, wherein the cross-sectional area of said vacuum chamber taken along the line perpendicular to the direction of the path of the charged particles is rectangular and recesses are formed in the inner corner portions of said vacuum chamber.

8. The charged particle accelerating apparatus according to claim 1, wherein said vaccum chamber has a multi-layer structure and said layer of the low gas-generating material constitutes the innermost layer.

9. The charged particle accelerating apparatus according to claim 8, wherein said vacuum chamber has a two layer structure.

10. The charged particle accelerating apparatus according to claim 9, wherein an aluminum alloy layer is disposed on the inner wall of said vacuum chamber made of a stainless steel.

11. The charged particle accelerator apparatus according to claim 1, wherein the cross-sectional area of said vacuum chamber taken along the line perpendicular to the direction of the path of the charged particles is rectangular and recesses are formed in the inner corner portions of said vacuum chamber.

* * * * *